US006304023B1

(12) United States Patent
Chan

(10) Patent No.: US 6,304,023 B1
(45) Date of Patent: Oct. 16, 2001

(54) SPARK PLUG FOR AN INTERNAL COMBUSTION ENGINE HAVING A HELICALLY-GROOVED ELECTRODE

(75) Inventor: Anthony K. Chan, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/260,100

(22) Filed: Mar. 2, 1999

(51) Int. Cl.[7] ..... H01T 13/20; F02P 1/00

(52) U.S. Cl. ..... 313/141; 313/118; 123/169 R

(58) Field of Search ..... 313/118–146; 123/643, 618, 608, 169 R

(56) References Cited

U.S. PATENT DOCUMENTS

| | | | | |
|---|---|---|---|---|
| 2,260,399 | | 10/1941 | Peters et al. | 123/169 |
| 2,500,395 | | 3/1950 | Arden | 123/145 |
| 2,591,025 | | 4/1952 | Tierney, Jr. et al. | 123/169 |
| 2,672,729 | | 3/1954 | Van Ry | 60/39.82 |
| 3,958,144 | | 5/1976 | Franks | 313/138 |
| 4,406,968 | | 9/1983 | Friese et al. | 313/136 |
| 4,970,427 | | 11/1990 | Scharnweber et al. | 313/146 |
| 5,211,142 | | 5/1993 | Matthews et al. | 123/143 B |
| 5,497,045 | | 3/1996 | Matsutani et al. | 313/141 |
| 5,529,046 | * | 6/1996 | Werner et al. | 123/643 |
| 5,650,687 | | 7/1997 | van den Bogaert | 313/141 |
| 5,697,334 | | 12/1997 | Below | 123/169 R |
| 5,725,405 | | 3/1998 | Nakatani | 445/4 |
| 5,751,096 | | 5/1998 | Lahens | 313/141 |
| 5,821,676 | * | 10/1998 | Atchinson, II et al. | 313/140 |
| 6,091,185 | * | 7/2000 | Matsubara et al. | 313/138 |

* cited by examiner

*Primary Examiner*—Ashok Patel
*Assistant Examiner*—Karabi Guharay
(74) *Attorney, Agent, or Firm*—Robert J. Hampsch; John J. Cheek

(57) ABSTRACT

A spark plug for an internal combustion engine comprising a center electrode having a shank portion which is fluted. The flutes have at least one edge which protrudes through an opening in a ground electrode of the spark plug. The principle use is for lean burn natural gas engines, however any air-fuel mixtures 14 will benefit from this invention. For example, propane or dual fuel engines may have spark plugs with this invention.

11 Claims, 2 Drawing Sheets

SPARK PLUG FOR AN INTERNAL COMBUSTION ENGINE HAVING A HELICALLY-GROOVED ELECTRODE

TECHNICAL FIELD

This invention relates generally to a spark plug for an internal combustion engine, and more particularly to a center electrode of a spark plug having an outer portion which is fluted.

BACKGROUND ART

Traditional spark plug construction includes a generally cylindrical shell body having a pair of ends, one of which is threaded. A co-axial ceramic insulator extends along the central axis of the cylindrical shell body from the threaded end through the shell body and beyond the opposite end. A co-axial center electrode extends along the central axis of the cylindrical shell body. The co-axial center electrode is exposed near the threaded end of the cylindrical shell body and is electrically connected through the insulator to a terminal. The terminal is connected to a spark plug wire which is used to provide a voltage signal to the center electrode. An "L" shaped ground electrode typically extends from the threaded end of the shell body forming a spark gap between the ground electrode and the center electrode. The spark gap is set to a pre-selected distance based on the internal combustion engine, i.e. the typical air-fuel mixture in the combustion chamber and the amount of energy that is required to combust the typical air-fuel mixture.

Several problems, such as carbonization, erosion, and pitting of spark plug components, typically center and ground electrodes that substantially reduce the life of the spark plug thereby requiring frequent replacement under normal operation of the internal combustion engine. Engines that require a lean air-fuel mixture run into a problem of maintaining complete combustion. Typically, spark plugs are designed based on air-fuel mixtures that will ignite over a broad range of applications. Having spark plug designs that are capable of operating with complete combustion for lean air-fuel mixtures requires a substantial energy level. In comparison, spark plugs designed using the substantial energy level for non lean air-fuel mixtures may have high current discharge and cause premature wear of the center and ground electrodes of the spark plug.

One of these problems involves carbonization and the depositing of lead, lead oxides, and other contaminants in and around the center and ground electrodes during the course of repeated electrical discharges. The contaminants that are deposited on the electrodes alter the impedance between the center and ground electrodes. The alteration of the impedance may cause the spark plug to have a weak spark or not to spark. The weak spark is due to the contaminants filling the gap between the center and ground electrodes allowing leakage of electrical energy between the center electrode and the ground electrode. Spark plugs that do not spark are when too much electrical energy is flowing from the center electrode to the ground electrode. To ensure proper operation, the engine spark plugs often need to have the electrodes cleaned of any contaminants or the spark plug is often replaced. The weak spark causes incomplete combustion of the air-fuel mixture in the combustion chamber which increases pollutants that are emitted from the engine and decreases the efficiency of the engine. Spark plugs that do not spark expel the air-fuel mixture from the combustion chamber and into the exhaust which increases pollutants that are emitted from the engine and decreases the efficiency of the engine.

Another problem occurring with conventional spark plug design is pitting and general physical deterioration of the center and ground electrodes after a certain period of operation. Pitting of the spark plug electrodes may increase the effective spark gap, thereby increasing the electrical potential needed for discharge. Pitting results in weak sparks and could ultimately lead to failure of the spark plug to spark.

Another problem that typically occurs with conventional spark plug design is maintaining complete combustion when a lean air-fuel mixture is desired for combustion. The lean air-fuel mixture requires a substantial level of energy and breakdown voltage from the ignition source (e.g. spark plug) to ignite the lean air-fuel mixture within the combustion chamber for complete combustion. The substantial level of energy in a spark ignited engine can lead to increase pitting and carbonization of the electrodes which requires replacement of the spark plug. Engines with lean air-fuel mixtures that operate using a lower level of energy in an attempt to minimize deterioration of the center and ground electrodes typically have incomplete combustion which increases the pollutants that are emitted from the engine. Incomplete combustion has undesirable exhaust byproducts, such as particulate matter. Regulation of exhaust byproducts are causing engines to be designed with ignition systems that maintains a more complete combustion thereby increasing the level of energy which may cause high current discharge, carbonization, and/or pitting of spark plug electrodes.

The present invention is directed to overcoming one or more of the problems as set forth above.

DISCLOSURE OF THE INVENTION

In one aspect of the present invention a spark plug comprises a shell body, a center electrode, and a ground electrode having a body portion bounded by a first surface and a second surface. The body portion has an opening therethrough between the first and second surfaces. The center electrode is insulateably connected to the shell body and has a shank portion which is fluted and protruding through said opening.

In another aspect of the present invention an engine ignition system comprises, a control module having an input connection and an output connection. The input connection electrically connects a sensor to the control module and the output connection electrically connects an ignition transformer to the control module. A spark plug has a center electrode and a ground electrode. The spark plug is electrically connected to the ignition transformer wherein the center electrode provides a concentrated electric field that initiates a spark.

BRIEF DESCRIPTION OF THE DRAWINGS

For a better understanding of the present invention, reference may be made to the accompanying drawings, in which.

Other aspects, objects and advantages of this invention can be obtained from a study of the drawings, the disclosure and the appended claims.

BEST MODE FOR CARRYING OUT THE INVENTION

Figure 1:
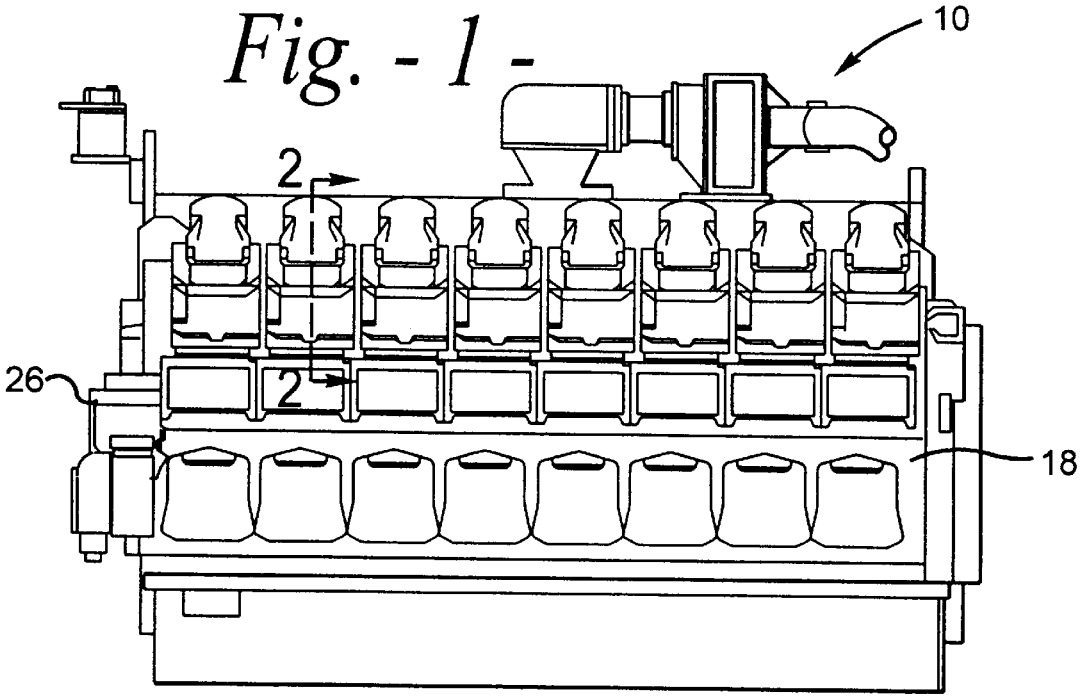
FIG. 1 is a diagrammatic plan view of an engine with a spark plug embodying the present invention.
Figure 2:
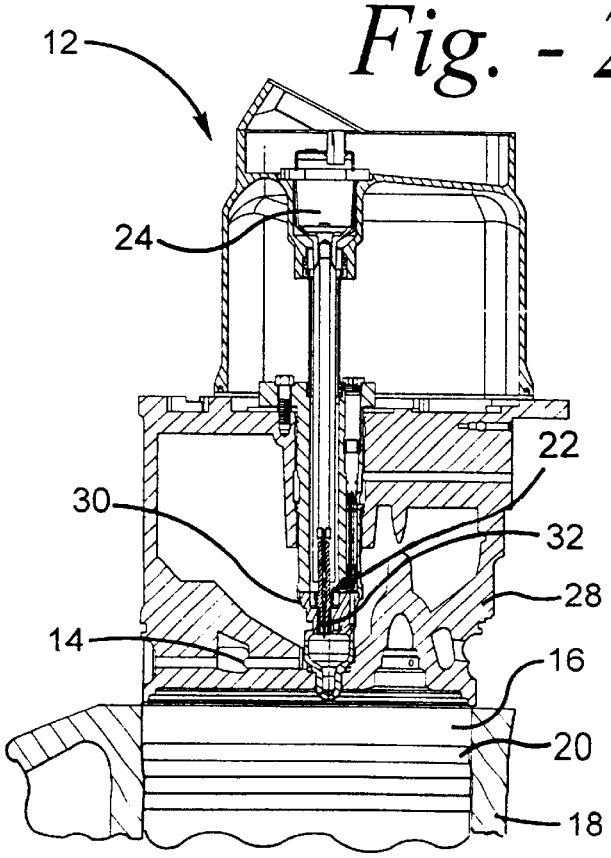
FIG. 2 is a diagrammatic partial cross sectional view of an engine with a spark plug embodying the present invention.

Referring to FIG. 1 and FIG. 2, an engine 10 which is, by example, a gas engine is shown with an ignition system 12 that may be utilized therewith. It is to be understood that, ignition systems 12 are also used with other types of engines 10, including, but not limited to, those that burn natural gas, propane, or dual fuel. Ignition systems 12 ignite an air-fuel mixture 14 in a combustion chamber 16 that is disposed in a cylinder block 18 of the engine 10. Fuel, such as natural gas, is mixed with inlet air using a butterfly valve (not shown) or an equivalent device, for example, a tuned orifice. The ratio of inlet air to gas, i.e. air-fuel ratio, is typically based on the application of the engine 10. The air-fuel mixture 14 is passed through inlet valves (not shown) at the appropriate time into the combustion chamber 16. The valves close, a crankshaft (not shown) is rotated moving a piston 20 towards top dead center, and the piston 20 compresses the air-fuel mixture 14 in the combustion chamber 16. The compressed air-fuel mixture 14 is then ignited by a spark plug 22.

In the present embodiment, an ignition transformer 24 applies a voltage to the spark plug 22. The ignition transformer 24 steps up the voltage to fire the spark plug 22. Location of the crankshaft (not shown) in respect to piston top dead center in combination with sensed engine parameters determines when and what magnitude the voltage is communicated to the spark plug 22, (i.e. ignition timing). The ignition timing is controlled by a speed timing sensor (not shown), and a control module 26. However, it should be understood that mechanical systems have magnetos that are used to communicate the voltage to the spark plug 22 without departing from the spirit of the invention. The control module 26 monitors engine operation through a series of sensors, for example, engine speed, air pressure, and detonation sensors. The control module 26 uses input from the sensors to determine the ignition timing. The control module 26 sends a signal to each ignition transformer 24 which causes the spark plug 22 to fire.

Figure 3:
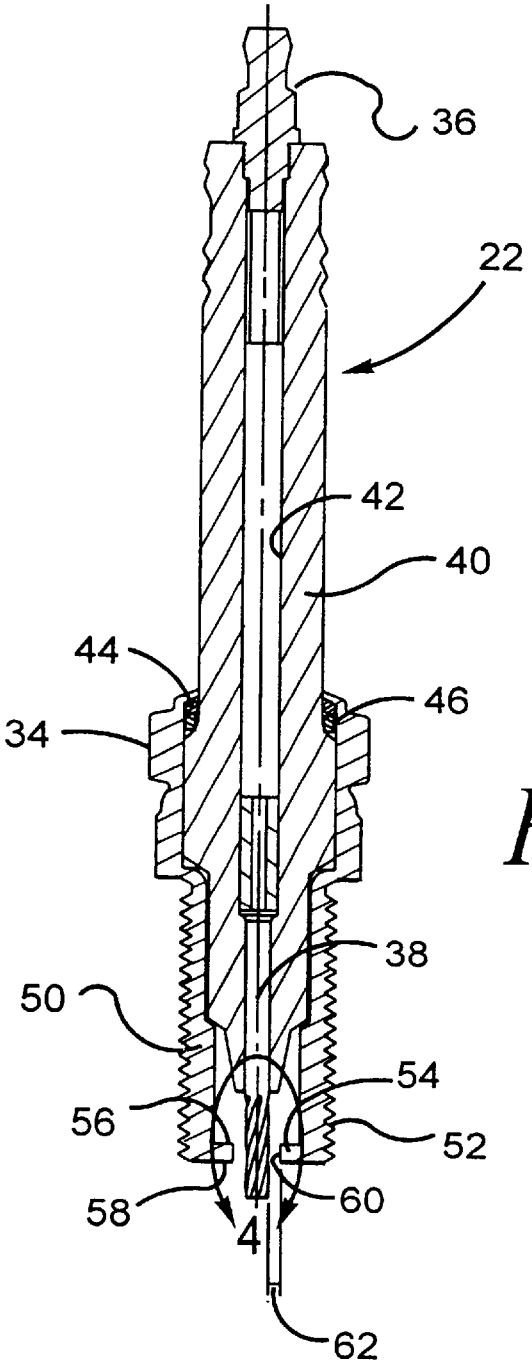
FIG. 3 is a diagrammatic cross sectional view of a spark plug embodying the present invention.

As seen in FIG. 2, the spark plug 22 is positioned in a cylinder head 28 using a spark plug adapter 30. As is well known in the art, the spark plug adapter 30 is disposed in the cylinder head 28 of the engine 10, has threads 32 for receiving the spark plug 22, and opens into the combustion chamber 16. The spark plug adapter 30 is preferably installed using a piece of hexagon bar stock and a wrench. The spark plug 22 has a generally cylindrical shell body 34 having a pair of ends, one of which is threaded into the spark plug adapter 30 to a predetermined torque. Having the spark plug 22 tightened to the predetermined torque provides adequate sealing between the spark plug 22 and the spark plug adapter 30 while also positioning the spark plug 22 in the combustion chamber 16. Proper sealing between the spark plug 22 and the spark plug adapter 30 allows the air-fuel mixture 14 to be compressed without leaks to the desired amount. Proper positioning of the spark plug 22 in the combustion chamber 16 is also critical. Having the spark plug 22 not extend far enough into the combustion chamber 16 may cause the piston 20 to hit the spark plug 22. Having the spark plug 22 position to far out of the combustion chamber 16 may cause incomplete combustion to occur. The spark plug 22 has a solid stud 36 as shown in FIG. 3 that is connected to the ignition transformer 24. As indicated above, the ignition transformer 24 provides the necessary voltage for firing the spark plug 22.

Referring to FIG. 3, the spark plug 22 embodying the present invention is shown. A center electrode 38 is insulateably connected to the shell body 34 of the spark plug 22. The insulated connection is in the form of a ceramic insulator 40. The ceramic insulator 40 has a bore 42 disposed therethrough for receiving the center electrode 38 and solid stud 36. The ceramic insulator 40 is attached to the shell body 34 using a lock ring 44 and a seal 46. It is to be recognized, however that ceramic insulators 40 may be attached to the shell body 34 using other types of connections, including, but not limited to, threading the ceramic insulator 40 into the shell body 34 or similar attaching means. The center electrode 38 has a shank portion 48 which will be discussed in more detail below.

The shell body 34 of the spark plug 22 is used for connecting the spark plug 22 to the spark plug adapter 30. The shell body 34 also provides a ground electrode 50 that is used in conjunction with the center electrode 38 to ignite the air-fuel mixture 14. The spark plug 22 is attached to the spark plug adapter 30 by using a threaded portion 52 of the shell body 34 with the threads 32 of the spark plug adapter 30, as previously discussed. However, it should be understood that the invention is also suitable for other types of spark plug connections, such as adhesives and lock-nuts that are well known in the art.

In the illustrated embodiment, the ground electrode 50 is adjacent to the threaded portion 52 of the shell body 34. The ground electrode 50 has a body portion 54 bounded by a first surface 56 and a second surface 58. The body portion 54 has an opening 60 therethrough between the first and second surfaces 56, 58 to allow the center electrode 38 to extend partially or completely through the opening 60 in the ground electrode 50 and into the combustion chamber 16. The ground electrode 50 as well as the opening 60 are preferably co-axial with the center electrode 38, such co-axial orientation of the center electrode and opening provides multiple equi-distant locations for a spark to occur during operation. The opening 60 has a generally circular shape when viewed in bottom plan view providing multiple spark plug gaps 62 being measured between the center and ground electrodes 38, 50. It is to be recognized that, openings 60 of other geometric shapes when viewed in plan view, include, but are not limited to, star and oval shaped openings may be used without departing from the spirit of the invention. The ground electrode 50 is preferably made of a copper alloy thereby reducing corrosion while providing an electrical conductor for the spark plug 22. However, it should be understood that the invention is also applicable to other type of materials, such as nickel, platinum, and steel alloys that are well known in the art.

Figure 4:
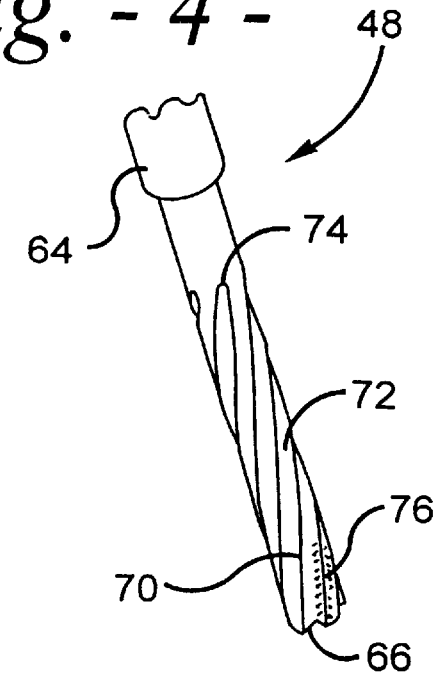
FIG. 4 is a diagrammatic view of a center electrode embodying the present invention.

The center electrode 38 has the shank portion 48 as shown in FIG. 3 and FIG. 4 with a proximal end 64, a distal end 66 which is fluted providing at least one edge 70 and an outer surface 72. The center electrode 38 is in electrical communication with the control module 26 through the solid stud 36. The characteristics of the center electrode 38 cause the ignited air-fuel mixture 14 to "swirl" from the spark plug 22 into the combustion chamber 16. The "swirl" of the ignited air-fuel mixture provides rapid flame propagation throughout the combustion chamber 16 thereby allowing a more complete combustion of the air-fuel mixture 14.

The proximal end 64 of the center electrode 38 engages the ceramic insulator 40 of the spark plug 22. Having the proximal end 64 of the center electrode 38 insulated from the ground electrode 50 of the shell body 34 allows the ignition transformer 24 to apply a voltage to the center electrode 38 of the spark plug 22, thereby producing a spark between the outer surface 72 of the center electrode 38 and a point on the ground electrode adjacent to or proximate to the opening 60 in the ground electrode 50. The spark that is emitted between the center electrode 38 and ground electrode 50 ignites the air-fuel mixture 14 in the combustion chamber 16.

The distal end 66 of the center electrode 38 is shown extending in FIG. 3, it is to be recognized that, the center electrode 38 extends partially through the opening 60 in the ground electrode 50. The distal end 66 that is adjacent to or proximate to the opening 60 in the ground electrode 50 determines the spark plug gaps 62. The distal end 66 is fluted comprising at least one groove 74 that is helically formed into the shank portion 48 of the center electrode 38. The fluted distal end 66 provides at least one edge 70 that is adjacent to or proximate to the opening 60 in the ground electrode 50. It is to be recognized that, center electrodes 38 are also used with other types of shank portions 48, including, but not limited to, distal ends 66 having grooves 74 longitudinally formed into the shank portion 48.

The edge 70 of the center electrode 38 as described above preferably coincides with the point of transition between the groove 74 and the outer surface 72 of the fluted distal end 66. The sharpness of the edge 70 is characterized by an angle measured at the transition between the groove 74 and the outer surface 72 of the fluted distal end 66. The angle, (i.e. sharpness of the edge 70) between the groove 74 and the outer surface 72 of the fluted distal end 66 determines the magnitude of a concentrated electrical field 76 that typically coincides with the point of transition. Generally, the magnitude of the concentrated electrical field 76 increases as the angle approaches ninety degrees. The concentrated electrical field 76 allows the ignition transformer 24 to apply lower voltage levels to the center electrode 38 while maintaining proper sparking of the spark plug 22. Having sharp grooves 74 inhibits the electrical field 76 from flowing between the edge 70 of the grooves 74 and the outer surface 72. Having the groove 74 and it's edge 70 extending through the opening 60 provides multiple equi-distant locations for the concentrated electrical field 76 for sparking. The multiple equi-distant locations on the center electrode 38 may be utilized after normal wear of the electrodes. The distal end 66 which is helically fluted also provides turbulence, (i.e. "swirl") to the air-fuel mixture 14 in the combustion chamber 16. The amount of turbulence that is typically imparted to the air-fuel mixture 14 is characterized by the grooves 74 in the distal end 66 of the center electrode 38. Typically, as the number of grooves 74 increase the amount of "swirl" is increased.

The outer surface 72 of the distal end 66 and at least one edge 70 of the groove 74 that is adjacent to or proximate to the opening 60 determines the spark plug gap 62. The spark plug gap 62 is defined as the shortest distance between the outer surface 72 of the center electrode 38 and the surface that defines the opening 60 in the ground electrode 50 in which a spark is traversed to ignite the air-fuel mixture 14. The spark plug gap 62 is generally located on the edge 70 due to the concentrated electric field 76. Having grooves 74 that are fluted provides the spark plug 22 with redundant points for initiating the spark. Having at least one edge 70 extending through the opening 60 provides multiple locations along the center electrode 38 for the spark plug gap 62 to occur depending on the wear of the spark plug 22. Effects of pitting and carbonization of the electrodes is minimized by having multiple locations along the edge for the spark plug gap 62 to occur.

Industrial Applicability

In operation, the control module 26 of the ignition system 12 uses input signals communicated from various sensors to determine the ignition timing. The air-fuel mixture 14 that is passed through the inlet valves of the engine 10 is ignited using the spark plugs 22. Ignition of the air-fuel mixture 14 is accomplished by sending a signal to the ignition transformers 24 from the control module 26. The ignition transformers 24 apply a voltage to the center electrode 38 of each spark plug 22. The ignition transformer 24 steps up the voltage to fire the spark plugs 22. The voltage signal to the ignition transformer 24 is stepped up using the control module 26. The control module 26 bases the voltage signal on sensed parameters that correspond to engine operation. The firing of the spark plug 22 usually takes place as the piston 20 approaches top dead center. The volume of the combustion chamber 16 decreases as the piston 20 approaches top dead center thereby providing the compressed air-fuel mixture 14 needed for combustion. The firing of the spark plug 22 provides a turbulent flame propagation into the compressed air-fuel mixture 14 allowing for a more complete combustion to occur. Spark plugs 22 using center electrodes 38 with it's fluted distal end 66 thereby provides the concentrated electrical field 76 necessary to ignite the air-fuel mixture 14 more completely at a lower voltage. Having spark plugs 22 that operate at a lower voltage improves the life of the spark plug. Having grooves 74 in the distal end 66 that are adjacent to or proximate to the opening 60 in the ground electrode 50 provides multiple locations for sparking after normal wear of the electrodes. Having multiple locations allow the location of the spark plug gap 62 to change relative to the center electrode 38 and ground electrode 50 without changing the spark plug gap 62 dimension. The carbonization and the depositing of lead, lead oxides, and other contaminants in and around the electrodes are minimized by using the center electrode 38 which is fluted by allowing "swirl" to provide turbulence to the air-fuel mixture 14 thereby aiding in completing combustion. Reduction in contaminant deposits on the electrodes also requires lower energy levels for firing the spark plug 22 while maintaining proper combustion of the air-fuel mixture 14. Lower energy level requirements for igniting the air-fuel mixture 14 reduces the pitting and general deterioration of the electrodes. Reducing the pitting and general deterioration of the electrodes helps to prolong the life of the spark plug 22. The center electrode 38 having the distal end 66 which is fluted improves combustion of the air-fuel mixture 14 by providing flame propagation with the "swirl" characteristic. The "swirl" characteristic increases the turbulence in the air-fuel mixture 14 during combustion. While the invention herein disclosed has been described by means of specific embodiments and processes associated therewith, numerous modifications and variations could be made thereto by those skilled in the art without departing from the scope of the invention as set forth in the claims.

What is claimed is:

1. A spark plug comprising:

a shell body;

a ground electrode having a body portion bounded by a first surface and a second surface, said body portion having an opening therethrough between said first and second surfaces; and a center electrode insulateably connected to said shell body and having a shank portion which is fluted providing at least one edge protruding through said opening;

wherein said edge has a helical configuration relative to said shank portion.

2. A spark plug comprising:

a body;

a first electrode mounted to said body; and a second electrode mounted to said body and being electrically insulated and spaced from said first electrode, said second electrode having a shank portion having an outer surface confronting said first electrode, said outer surface having at least one helical groove formed therein.

3. The spark plug of claim 2 wherein said first electrode comprises a ground electrode.

4. The spark plug of claim 2 wherein said second electrode has plural helical grooves formed in the outer surface thereof.

5. The spark plug of claim 2 wherein said at least one helical groove is configured to impart swirl to an air-fuel mixture ignited by said spark plug.

6. An engine ignition system comprising:

an ignition transformer;

a control module electrically connected with said ignition transformer; and a spark plug electrically connected with said ignition transformer, said spark plug comprising the spark plug of claim 2.

7. The engine ignition system of claim 6 wherein said first electrode comprises a ground electrode and wherein said second electrode is electrically connected with said ignition transformer.

8. The engine ignition system of claim 6 wherein said second electrode has plural helical grooves formed in the outer surface thereof.

9. The engine ignition system of claim 6 wherein said at least one helical groove is configured to impart swirl to an air-fuel mixture ignited by said spark plug.

10. A method of igniting an air-fuel mixture in an internal combustion engine, comprising:

allowing an air-fuel mixture to be near a spark plug having mutually-spaced first and second electrodes, wherein one of said electrodes has a shank portion having an outer surface confronting the other of said electrodes, said outer surface having a helical groove formed therein;

connecting one of said electrodes to ground;

applying a electrical current to the other, non-grounded one of said electrodes to produce a spark between said first and second electrodes, thereby igniting said air-fuel mixture; and expanding said ignited air-fuel mixture along the outer surface of the electrode shank portion having at least one helical groove therein to thereby impart swirl to said ignited air-fuel mixture.

11. The method of claim 10 wherein said non-grounded electrode comprises the electrode having a helical groove formed in the outer surface of a shank portion thereof.

* * * * *